US007640878B2

(12) United States Patent
Gardner

(10) Patent No.: US 7,640,878 B2
(45) Date of Patent: Jan. 5, 2010

(54) APPARATUS AND METHOD FOR COUPLING AN EMBROIDERY ACCESSORY TO AN EMBROIDERY MACHINE

(75) Inventor: Gary Allen Gardner, Dallas, TX (US)

(73) Assignee: Great Notions News, Inc., Dallas, TX (US)

( * ) Notice: Subject to any disclaimer, the term of this patent is extended or adjusted under 35 U.S.C. 154(b) by 103 days.

(21) Appl. No.: 11/851,926

(22) Filed: Sep. 7, 2007

(65) Prior Publication Data

US 2009/0064913 A1 Mar. 12, 2009

(51) Int. Cl.
*D05B 39/00* (2006.01)
*D05C 9/04* (2006.01)

(52) U.S. Cl. ..... 112/103

(58) Field of Classification Search ..... 112/103, 112/470.14, 475.11; 38/102.2; 101/127.1; 160/371, 378

See application file for complete search history.

(56) References Cited

U.S. PATENT DOCUMENTS

| | | | | |
|---|---|---|---|---|
| 2,141,294 | A * | 12/1938 | De Cardy | 112/103 |
| 4,763,587 | A | 8/1988 | Frye | |
| 4,870,917 | A * | 10/1989 | Frye | 112/470.06 |
| 4,993,333 | A * | 2/1991 | Moore, III | 112/103 |
| 5,018,460 | A | 5/1991 | Schilling et al. | |
| 5,228,401 | A | 7/1993 | Moore, III | |
| 5,261,340 | A | 11/1993 | Conley, Jr. et al. | |
| 5,291,843 | A * | 3/1994 | Hori | 112/103 |
| 5,353,725 | A * | 10/1994 | Sakakibara | 112/103 |
| 5,555,828 | A | 9/1996 | Rowley | |
| 5,842,429 | A | 12/1998 | Gulotta | |
| 5,967,067 | A | 10/1999 | Guenther | |
| 6,227,129 | B1 | 5/2001 | Parker, Jr. | |
| 6,336,416 | B1 | 1/2002 | French et al. | |
| 6,374,760 | B1 | 4/2002 | Moore, III | |
| 6,394,012 | B1 | 5/2002 | French et al. | |
| 6,457,428 | B1 | 10/2002 | Vickroy | |
| 6,694,906 | B1 | 2/2004 | Buck | |
| 6,889,621 | B2 * | 5/2005 | Kawaguchi et al. | 112/103 |
| 7,194,966 | B2 * | 3/2007 | Tajima et al. | 112/103 |

FOREIGN PATENT DOCUMENTS

| | | |
|---|---|---|
| CA | 2179119 | 11/1999 |
| JP | 03130456 | 6/1991 |
| JP | 2001192959 | 7/2001 |
| WO | 2004099482 A1 | 11/2004 |

* cited by examiner

*Primary Examiner*—Ismael Izaguirre
(74) *Attorney, Agent, or Firm*—Yee & Associates, P.C.; Catherine K. Kinslow

(57) ABSTRACT

The illustrative embodiments described herein are directed toward an apparatus and method for coupling an embroidery accessory to an embroidery machine. The apparatus includes a support bar. The support bar is coupled to the embroidery machine. The apparatus also includes a set of acceptors. The set of acceptors are attached to the support bar. The apparatus also includes an embroidery accessory. The embroidery accessory includes a set of attachment adapters. The set of attachment adapters are adapted to be coupled to the set of acceptors.

19 Claims, 6 Drawing Sheets

APPARATUS AND METHOD FOR COUPLING AN EMBROIDERY ACCESSORY TO AN EMBROIDERY MACHINE

BACKGROUND OF THE INVENTION

1. Technical Field

The present invention is directed generally toward devices and methods for coupling an embroidery accessory to an embroidery machine.

2. Description of Related Art

Embroidery is generally used to create a decorative design or pattern on a piece of fabric. The fabric may be composed of any material, such as cotton, wool, polyester, plastic, silk, velvet, linen, or any other material capable of being stitched. A pattern may be embroidered onto the piece of fabric using an embroidery machine.

Embroidery machines lessen the amount of time and labor that is necessary to embroider an item by automating the embroidery process. For example, embroidery designs may be embedded in files that are loaded onto a computer. An embroidery machine may then communicate with the computer and embroider the designs that are contained on the files.

Embroidery machines require the use of an embroidery accessory in order to embroider a pattern onto fabric. The fabric is mounted onto the embroidery accessory so that the head of the embroidery machine may embroider the pattern on the fabric. Stabilizer or other types of backing may also be mounted on the embroidery accessory. Some embroidery accessories that are currently available for use with embroidery machines include cap devices, frames, or a set of arms.

However, attaching one of the currently available embroidery accessories to an embroidery machine can be cumbersome and time-consuming. For example, most current embroidery accessories must be bolted directly onto the pantograph of the embroidery machine. These types of embroidery accessories require an operator to bolt or unbolt embroidery accessories to and from the pantograph each time a new embroidery accessory is used, which can be cumbersome and time-consuming. This cumbersome and time-consuming method decreases the efficiency at which patterns may be embroidered onto pieces of fabric. Current methods for attaching and detaching embroidery accessories to and from an embroidery machine also require the use of one or more tools, such as a screwdriver or wrench. The need for additional tools presents an additional inconvenience of the current method for coupling and decoupling an embroidery accessory to and from an embroidery machine.

SUMMARY OF THE INVENTION

The illustrative embodiments described herein are directed toward an apparatus and method for coupling an embroidery accessory to an embroidery machine. The apparatus includes a support bar. The support bar is coupled to the embroidery machine. The apparatus also includes a set of acceptors. The set of acceptors are attached to the support bar. The apparatus also includes an embroidery accessory. The embroidery accessory includes a set of attachment adapters. The set of attachment adapters are adapted to be coupled to the set of acceptors.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION

The illustrative embodiments described herein are directed toward an apparatus and method for coupling an embroidery accessory to an embroidery machine. As used herein, the term "coupling" includes coupling via a separate object. For example, an embroidery accessory can be coupled to an embroidery machine if both the embroidery accessory and the embroidery machine are coupled to a third object. The term "coupling" also includes "directly coupling," in which case the two objects touch each other in some way. The apparatus includes a support bar. The support bar is coupled to the embroidery machine. The apparatus also includes a set of acceptors. The set of acceptors includes one or more acceptors. The set of acceptors are attached to the support bar. The apparatus also includes an embroidery accessory. The embroidery accessory includes a set of attachment adapters. The set of attachment adapters include one or more attachment adapters, and are adapted to be coupled to the set of acceptors.

In one embodiment, the apparatus also includes a set of magnets that are disposed between the support bar and the set of acceptors. The set of magnets includes one or more magnets. In another embodiment, the apparatus may also include a set of magnet notches that are disposed on the set of acceptors. The set of magnet notches includes one or more magnet notches. In this embodiment, each set of magnet notches is adapted to hold one of the set of magnets.

In another embodiment, the apparatus includes a set of adapter notches. In this embodiment, each set of attachment adapters includes at least one set of adapter notches. Also, each set of magnets may be adapted to be inserted into a respective set of adapter notches.

Figure 1:
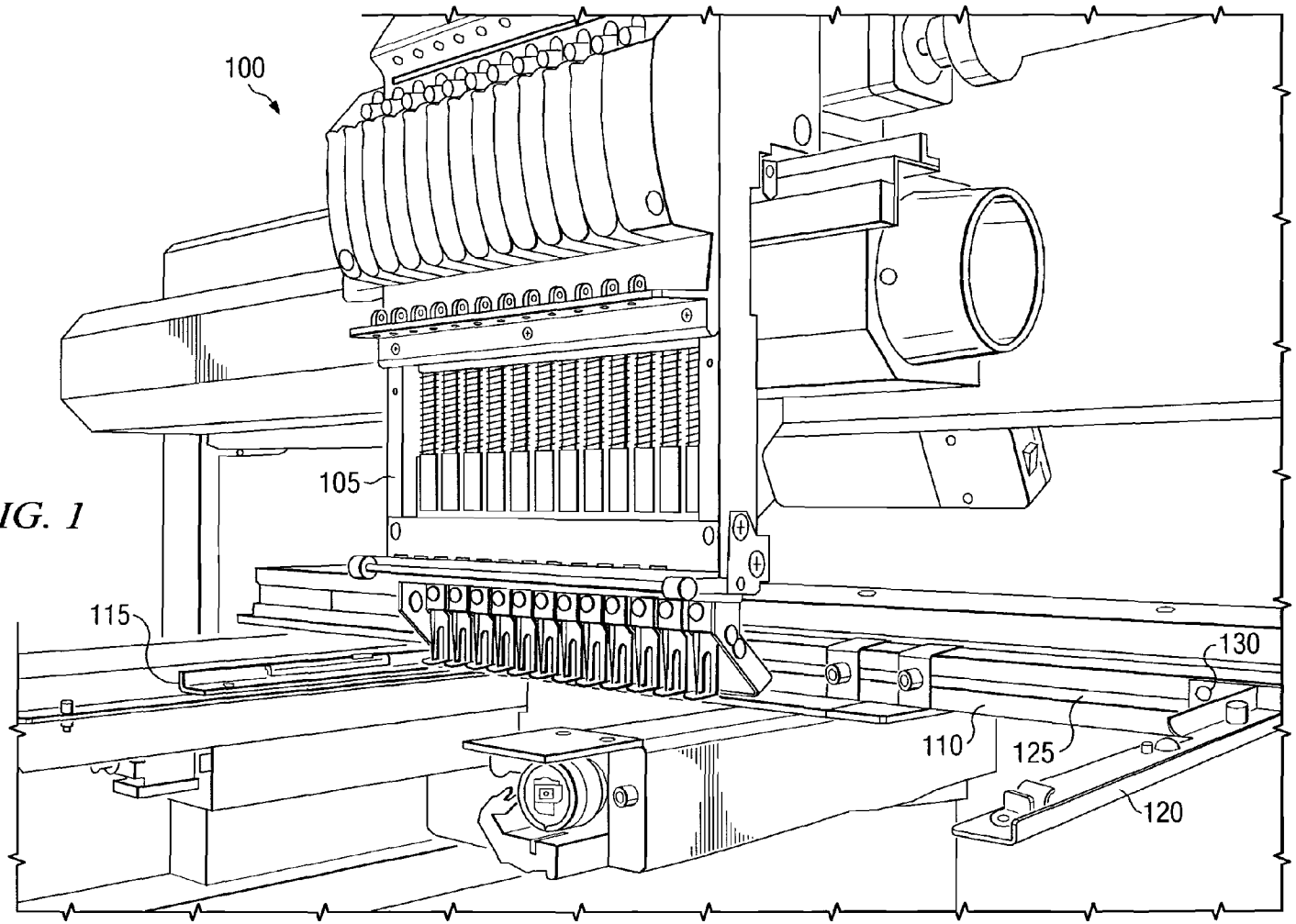
FIG. 1 shows an embroidery machine in accordance with an illustrative embodiment.

Turning now to FIG. 1, an embroidery machine is depicted in accordance with an illustrative embodiment. Specifically, FIG. 1 shows embroidery machine 100, which is an example of a currently available embroidery machine that may be used to implement an apparatus for coupling an embroidery accessory to an embroidery machine.

Embroidery machine 100 includes head 105. Head 105 contains needles and threads that are used to embroider a piece of fabric. For example, head 105 may contain multiple needles and threads that each has a different color for embroidering multi-color patterns onto a piece of fabric. Although embroidery machine 100 has a single head 105, embroidery machine 100 may also include multiple heads.

Embroidery machine 100 also includes pantograph 110. A pantograph is a bar, rack, holder, or other supporting structure on which an embroidery accessory may be attached. Pantograph 110 moves horizontally and in X and Y directions relative to head 105. Pantograph 110 may be controlled electronically or mechanically depending on the type of embroidery machine.

Pantograph 110 supports arms 115 and 120. Specifically, arms 115 and 120 are screwed into pantograph 110 at pantograph mounting notch 125. For example, screw 130 holds arm 120 onto pantograph 110.

Arms 115 and 120 constitute one type of embroidery accessories that may be mounted onto embroidery machine 100. Arms 115 and 120 may be used to hold a hoop on which a piece of fabric and stabilizer may be mounted. Because arms 115 and 120 are attached to pantograph 110, arms 115 and 120, pantograph 110, a hoop, and the piece of fabric all move in unison in X and Y directions relative to head 105 while head 105 embroiders a pattern onto the piece of fabric.

Figure 2:
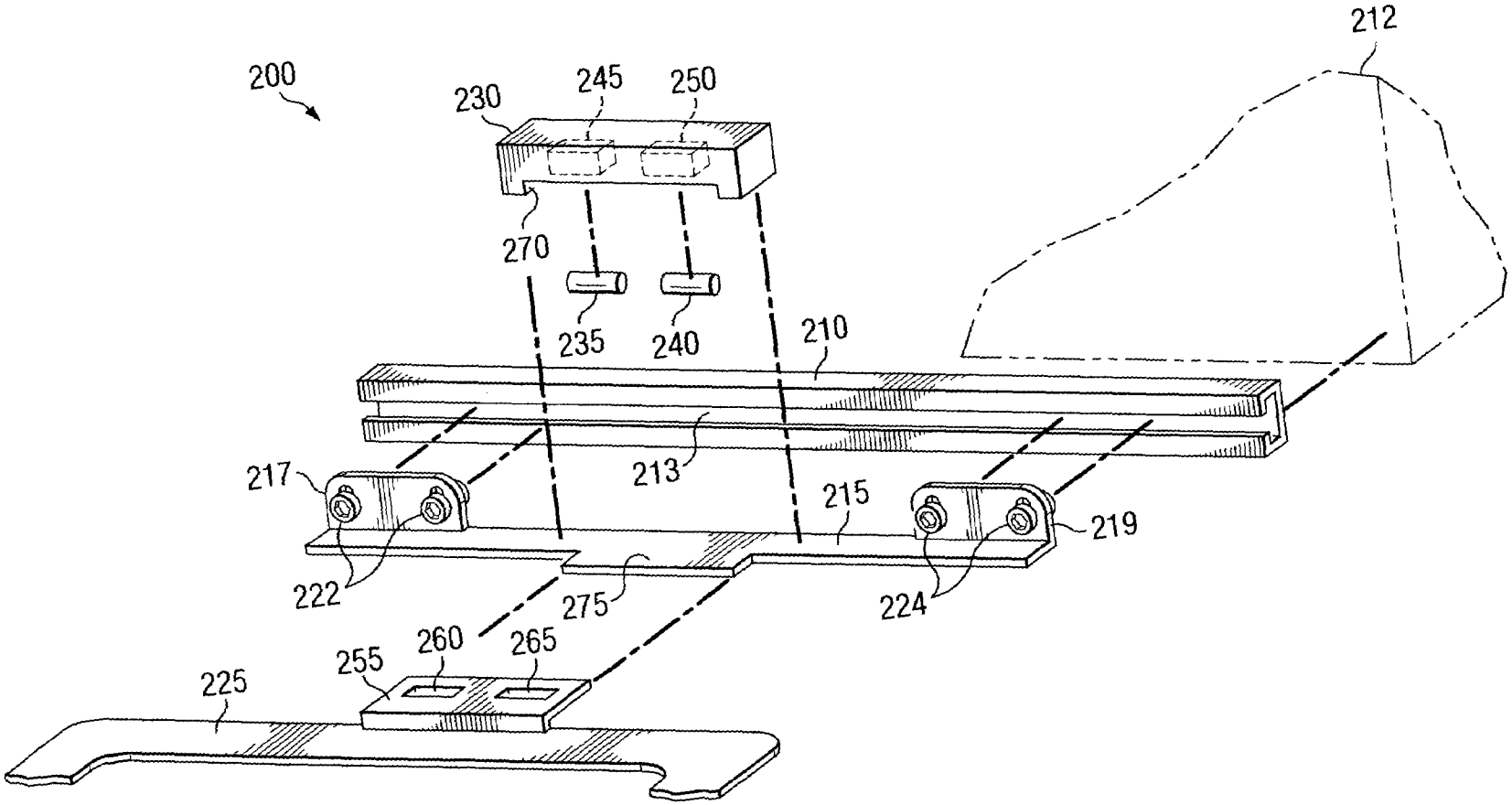
FIG. 2 shows an apparatus for coupling an embroidery accessory to an embroidery machine in accordance with an illustrative embodiment.

Turning now to FIG. 2, an apparatus for coupling an embroidery accessory to an embroidery machine is depicted in accordance with an illustrative embodiment. Specifically, FIG. 2 shows embroidery accessory coupling system 200, which is implemented on embroidery machine 212, which is an example of embroidery machine 100 in FIG. 1.

Embroidery accessory coupling system 200 includes pantograph 210, which is a non-limiting example of pantograph 110 in FIG. 1. Pantograph 210 may be coupled to embroidery machine 212 in a similar manner as pantograph 110 in FIG. 1. For example, pantograph 210 may be bolted, screwed, snapped, welded, or glued onto embroidery machine 212. Pantograph 210 may be any length and may be composed of any material, such as metal or plastic.

Embroidery accessory coupling system 200 includes support bar 215, which may be coupled to embroidery machine 212. In one embodiment, support bar 215 is coupled to embroidery machine 212 by pantograph 210. Pantograph 210 includes pantograph mounting notch 213, which is used for mounting support bar 215 onto pantograph 210. Support bar mounts 217 and 219, which are attached to support bar 215, may be adjoined to pantograph 210 using mounting bolts 222 and 224. Support bar mounts 217 and 219 are used to couple support bar 215 to pantograph 210. Mounting bolt 222 couples support bar mount 217 to pantograph 210 at pantograph mounting notch 213. Similarly, mounting bolt 224 couples support bar mount 219 to pantograph 210 at pantograph mounting notch 213.

Although FIG. 2 shows two support bar mounts 217 and 219, any number of support bar mounts may be attached to support bar 215. For example, support bar 215 may include one, three, or ten support bar mounts that may be used to mount support bar 215 to pantograph 210. Also, support bar mounts 217 and 219 may be coupled to pantograph 210 in any of a variety of ways. For example, support bar mounts 217 and 219 may be screwed, welded, glued, interlocked, magnetically coupled, or contiguous with pantograph 210. The term "contiguous," as used herein, includes two components that are connected without any visible boundary. For example, support bar mounts 217 and 219 and pantograph 210 may form part of the same structure and have no visible boundary between them.

Support bar mounts 217 and 219 may be slidably or hingably coupled to pantograph 210. For example, support bar mounts 217 and 219 may be shaped such that they may be inserted into pantograph mounting notch 213 and slid along the length of pantograph mounting notch 213. Support bar 215 or support bar mounts 217 and 219 may include a button, lever, latch, or other similar device to prevent support bar 215 from sliding or hinging relative to pantograph 210. This button, lever, latch, or other similar device prevents support bar 215 from moving relative to pantograph 210 when the embroidery machine is in operation.

Although support bar 215 is shown coupled to pantograph 210 via support bar mounts 217 and 219, support bar 215 may be coupled to pantograph 210 in a variety of ways. For example, support bar 215 may be directly attached to pantograph 210 without the use of support bar mounts 217 and 219. In this example, support bar 215 may be directly bolted, screwed, welded, glued, interlocked, or magnetically coupled to pantograph 210. In another example, pantograph 210 and support bar 215 form one contiguous device, thereby eliminating the need to couple support bar 215 to pantograph 210.

In another example, support bar 215 may be slidably or hingably coupled to pantograph 210. For example, support bar 215 may be shaped to allow insertion into pantograph mounting notch 213 and slid along the length of pantograph mounting notch 213. In this example, support bar 215 may include a button, lever, latch, or other similar device to prevent support bar 215 from sliding or hinging relative to pantograph 210. This button, lever, latch, or other similar device prevents support bar 215 from moving relative to pantograph 210 when the embroidery machine is in operation.

Support bar 215 may be composed of any material that is able to support embroidery accessory 225, such as metal, plastic, wood, or any combination thereof. Support bar 215 may also be magnetic. In addition, support bar 215 may have any shape or length. For example, support bar 215 may have a square, elliptical, or triangular shape of any size. The material composition, shape, and length of support bar 215 may depend on a variety of factors, such as the structure of embroidery machine 212 and the ability of support bar 215 to support embroidery accessory 225. For example, the material composition and length of support bar 215 may depend on the size, structure, and composition of pantograph 210 or embroidery accessory 225. The material composition and length of support bar 215 may also depend on cost, labor, weight, durability, and shipping considerations.

Embroidery accessory coupling system 200 also includes acceptor 230. Acceptor 230 is attached to support bar 215. Acceptor 230 may be attached to support bar 215 at any location along support bar 215, such as the center or one of the ends of support bar 215. Although FIG. 2 shows a single acceptor 230, any number of acceptors may be attached to support bar 215, such as two, three, or five.

Although acceptor 230 is shown as a rectangular prism, acceptor 230 may have any shape, such as cube, elliptical cylinder, circular cylinder, or triangular prism. Also, acceptor 230 may be composed of any of a variety of materials, such as metal, plastic, wood, or any combination thereof. Acceptor 230 may also be magnetic. Acceptor 230 may also be coupled to support bar 215 in a variety of ways. For example, acceptor 230 may be bolted, screwed, welded, glued, hinged, or snapped onto support bar 215. In addition, acceptor 230 may be magnetically coupled to support bar 215, such as in the example in which either or both acceptor 230 or support bar 215 are made of a magnetic material.

The shape, composition, and method of attaching acceptor 230 may be based on a number of considerations, such as the structure of embroidery machine 212 or support bar 215 and the ability of acceptor 230 to support or receive embroidery accessory 225. For example, the material composition and shape of acceptor 230 may depend on the size, structure, and composition of support bar 215 or embroidery accessory 225. The material composition and length of acceptor 230 may also depend on cost, labor, weight, durability, and shipping considerations.

Embroidery accessory coupling system 200 also includes magnets 235 and 240. In one embodiment, magnets 235 and 240 are disposed between support bar 215 and acceptor 230. Magnets 235 and 240 both have cylindrical shapes. However, magnets 235 and 240 may have any shape, such as a cube, rectangular prism, ring, elliptical cylinder, or triangular prism. Magnets 235 and 240 may be composed of any material that is capable of being magnetic.

Although FIG. 2 shows two magnets 235 and 240, embroidery accessory coupling system 200 may have any number of magnets, such as one, six, or eleven. For example, embroidery accessory coupling system 200 may include two magnets for each acceptor that is attached to support bar 215. Thus, in the example in which two acceptors are attached to support bar 215, embroidery accessory coupling system 200 would include four magnets.

Embroidery accessory coupling system 200 includes magnet notches 245 and 250. Magnet notches 245 and 250 are any structure capable of affecting the position of magnets 235 and 240. In one embodiment, magnet notches 245 and 250 are disposed on acceptor 230. Each of magnet notches 245 and 250 are adapted to hold or contain one of magnets 235 and 240. For example, magnet notches 245 and 250 restrain the movement of magnets 235 and 240 such that magnets 235 and 240 are disposed at a particular location relative to support bar 215 and acceptor 230. FIG. 2 shows that magnet notch 245 is adapted to hold magnet 235 into a particular position and that magnet notch 250 is adapted to hold magnet 240 into a particular position.

Although acceptor 230 is shown as including two magnet notches 245 and 250, acceptor 230 may have any number of magnet notches. For example, acceptor 230 may have a single magnet notch that is adapted for holding any number of magnets into a particular position. Also, magnet notches 245 and 250 may have any shape and size that is capable of maintaining the position of magnets 235 and 240 into a particular position. Hence, in one embodiment, the shape of magnet notches 245 and 250 depends on the shape and structure of magnets 235 and 240.

Embroidery accessory coupling system 200 includes attachment adapter 255. Specifically, attachment adapter 255 is attached to embroidery accessory 225. In one embodiment, attachment adapter 255 is contiguous with the structure of embroidery accessory 225. However, attachment adapter 255 may also be a separate structure that is coupled to embroidery accessory 225. For example, attachment adapter 255 may be bolted, screwed, welded, glued, or hinged to embroidery accessory 225. Attachment adapter 255 and embroidery accessory 225 may have complementary interlocking structures such that attachment adapter 255 may be snapped onto embroidery accessory 225.

Attachment adapter 255 includes adapter notches 260 and 265. Adapter notches 260 and 265 are holes or grooves that allow embroidery accessory 225 to be held or gripped by acceptor 230 and magnets 235 and 240. Although adapter notches 260 and 265 have rectangular shape, adapter notches 260 and 265 have any shape, such as square, elliptical, circular, or triangular. In one embodiment, the shape of adapter notches 260 and 265 has the same shape or follows the contours of magnets 235 and 240.

Also, although attachment adapter 255 includes two adapter notches 260 and 265, attachment adapter 255 may include any number of adapter notches, such as one, three, or ten. In one embodiment, embroidery accessory coupling system 200 has the same number of magnets, magnet notches, and adapter notches. For example, FIG. 2 shows embroidery accessory coupling system 200 as having two magnets 235 and 240, two magnet notches 245 and 250, and two adapter notches 260 and 265. In a different example, embroidery accessory coupling system 200 may have two magnets, one magnet notch, and one adapter notch.

In one embodiment, magnets 235 and 240 are adapted to be inserted into adapter notches 260 and 265, respectively. The term "inserted" is here used to mean that all or a portion of magnets 235 and 240 cross into a space defined by adapter notches 260 and 265. In another embodiment, magnets 235 and 240 are "inserted" into adapter notches 260 and 265 when magnets 235 and 240 are fitted or partially fitted into a space defined by adapter notches 260 and 265.

Attachment adapter 255 may be inserted into acceptor notch 270. Acceptor notch 270 is a space included in acceptor 230 that allows acceptor 230 to receive attachment adapter 255. Upon inserting attachment adapter 255 into acceptor notch 270, magnets 235 and 240 are inserted into adapter notches 260 and 265, respectively. In one embodiment, the magnetic attraction between magnets 235 and 240 and support bar 215, which traverses the space defined by adapter notches 260 and 265, holds attachment adapter 255 firmly into place. The position of attachment adapter 255 may also be held into place by the magnetic attraction between magnets 235 and 240, acceptor 230 and attachment adapter 255. Embroidery accessory 225 is also supported by lip 275, which prevents embroidery accessory 225 from moving in a downward vertical direction.

Thus, embroidery accessory coupling system 200 allows embroidery accessory 225 to be quickly inserted into and held firmly into place by embroidery machine 212 without the use of tools, such as screwdrivers and wrenches. Embroidery accessory 225 may also be quickly decoupled from embroidery machine 212. For example, attachment adapter 255 may be pulled with sufficient force to overcome the magnetic attraction of magnets 235 and 240. In this example, sufficient room is provided by magnet notches 245 and 250 for magnets 235 and 240 to be removed from the space defined by adapter notches 260 and 265, thereby allowing attachment adapter 255 to be removed from acceptor notch 270.

Figure 3:
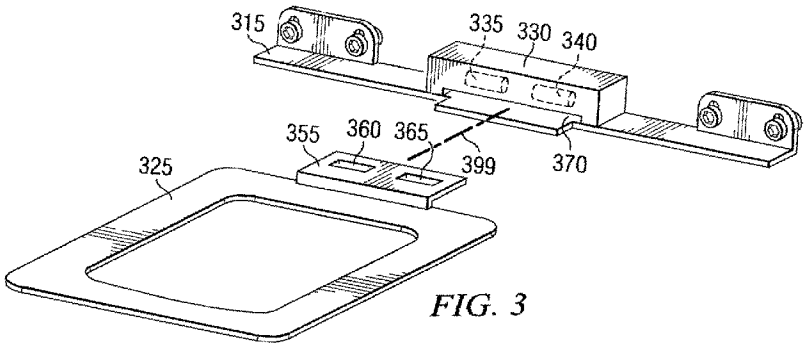
FIG. 3 shows an apparatus for coupling a frame to an embroidery machine in accordance with an illustrative embodiment.

Turning now to FIG. 3, an apparatus for coupling a frame to an embroidery machine is depicted in accordance with an illustrative embodiment. Specifically, FIG. 3 shows an embroidery accessory coupling system, such as embroidery accessory coupling system 200 in FIG. 2, in which frame 325 may be coupled to an embroidery machine, such as embroidery machine 100 in FIG. 1 and embroidery machine 212 in FIG. 2.

Frame 325 is a non-limiting example of embroidery accessory 225 in FIG. 2. Frame 325 may be used to mount a piece of fabric such that the embroidery machine may embroider a pattern onto the piece of fabric. Frame 325 may also be a magnetic frame, such as a Magna Frame. Frame 325 is coupled to attachment adapter 355.

As depicted by coupling indicator 399, attachment adapter 355 may be inserted into acceptor 330 at acceptor notch 370. Acceptor 330 contains magnets 335 and 340, which fit or partially fit into the space defined by adapter notches 360 and 365. Upon insertion, attachment adapter 355, and therefore frame 325, are held firmly into place by the magnetic attraction between magnets 335 and 340, support bar 315, acceptor 330, attachment adapter 355, or any combination thereof.

Figure 4:
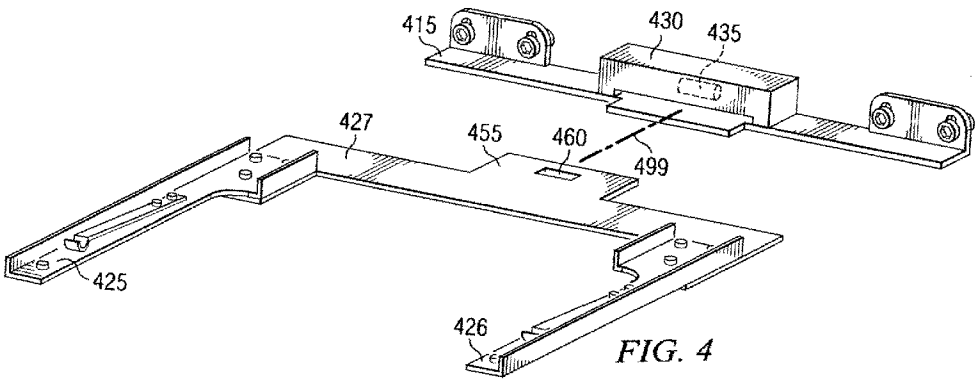
FIG. 4 shows an apparatus for coupling a set of arms to an embroidery machine in accordance with an illustrative embodiment.

Turning now to FIG. 4, an apparatus for coupling a set of arms to an embroidery machine is depicted in accordance with an illustrative embodiment. Specifically, FIG. 4 shows an embroidery accessory coupling system, such as embroidery accessory coupling system 200 in FIG. 2, in which arms 425 and 426 may be coupled to an embroidery machine, such as embroidery machine 100 in FIG. 1 and embroidery machine 212 in FIG. 2.

Arms 425 and 426 are a non-limiting example of embroidery accessory 225 in FIG. 2. Arms 425 and 426 may be used to hold a hoop. The hoop that is mounted on arms 425 and 426 may be used to hold a piece of fabric and stabilizer, onto which the embroidery machine may embroider a pattern.

Arms 425 and 426 are coupled to one another by arm connector 427. Arms 425 and 426 may be coupled to arm connector 427 in a variety of ways. For example, arms 425 and 426 may be bolted, screwed, welded, glued, or magnetically attached to arm connector 427. Arms 425 and 426 may also be contiguous with arm connector 427. In FIG. 4, attachment adapter 455 is contiguous with arm connector 427, although attachment adapter 455 may be coupled to arm connector 427 using any of the aforementioned attachment techniques.

As depicted by coupling indicator 499, attachment adapter 455 may be inserted into acceptor 430. Acceptor 430 contains magnet 435, which fits or partially fits into the space defined by adapter notch 460. Upon insertion, attachment adapter 455, and therefore arms 425 and 426, are held firmly into place by the magnetic attraction between magnet 435, support bar 415, acceptor 430, attachment adapter 455, or any combination thereof.

Figure 5:
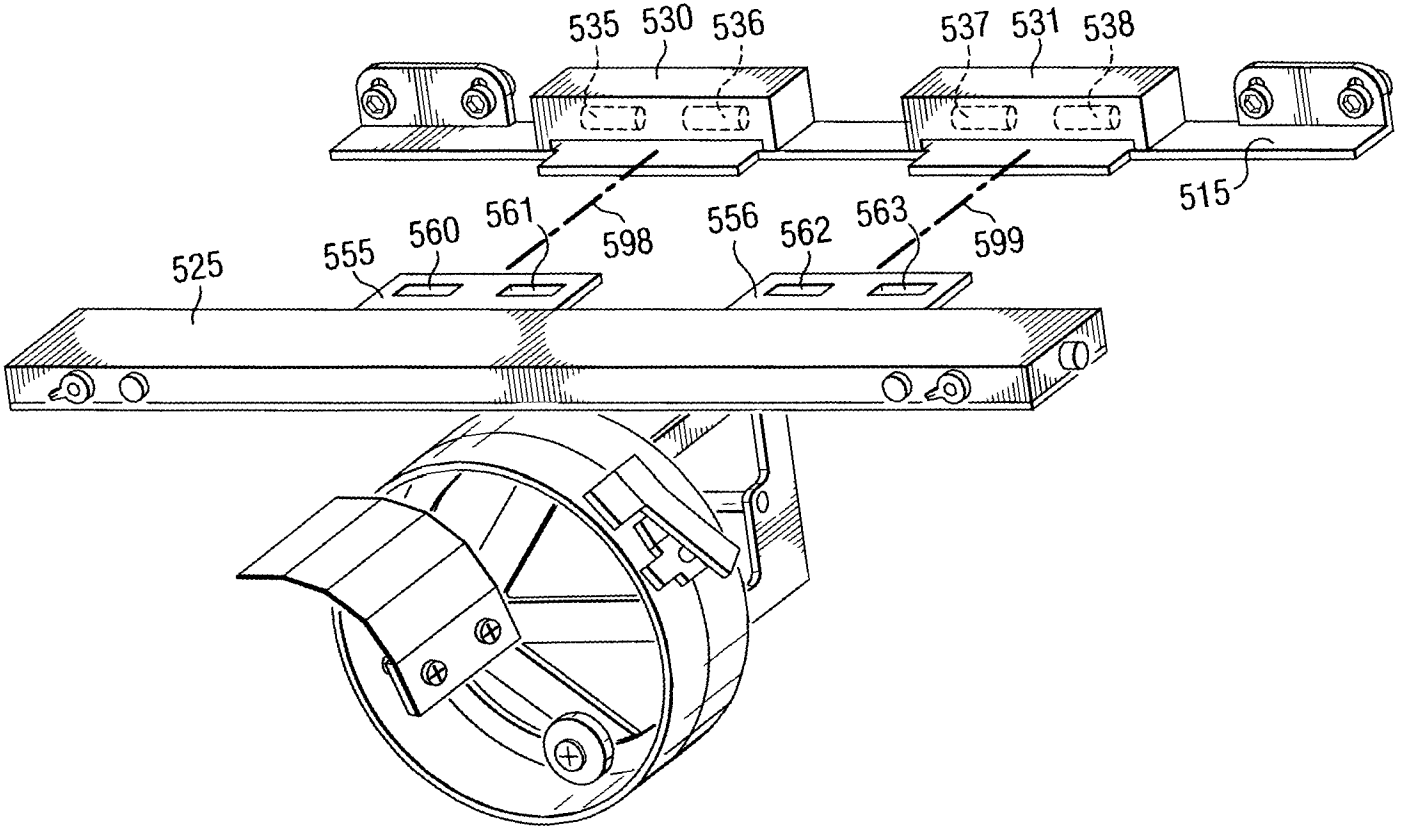
FIG. 5 shows an apparatus for coupling a cap device to an embroidery machine in accordance with an illustrative embodiment.

Turning now to FIG. 5, an apparatus for coupling a cap device to an embroidery machine is depicted in accordance with an illustrative embodiment. Specifically, FIG. 5 shows an embroidery accessory coupling system, such as embroidery accessory coupling system 200 in FIG. 2, in which cap device 525 may be coupled to an embroidery machine, such as embroidery machine 100 in FIG. 1 and embroidery machine 212 in FIG. 2.

Cap device 525 is a non-limiting example of embroidery accessory 225 in FIG. 2. A cap, hat, or similar article of clothes may be mounted onto cap device 525 such that the embroidery machine may embroider a pattern onto the article. Attachment adapters 555 and 556 are coupled to cap device 525.

Cap device 525 is coupled to support bar 515 using two attachment adapters and two acceptors. Specifically, as depicted by coupling indicator 598, attachment adapter 555 may be inserted into acceptor 530. Similarly, as depicted by coupling indicator 599, attachment adapter 556 may be inserted into acceptor 531. Acceptor 530 contains magnets 535 and 536 and acceptor 531 contains magnets 537 and 538. Magnets 535, 536, 537, and 538 fit or partially fit into the space defined by adapter notches 560, 561, 562, and 563. Upon insertion, attachment adapters 555 and 556, and therefore cap device 525, are held firmly into place by the magnetic attraction between magnets 535, 536, 537, and 538, support bar 515, acceptors 530 and 531, attachment adapters 555 and 556, or any combination thereof.

Figure 6:
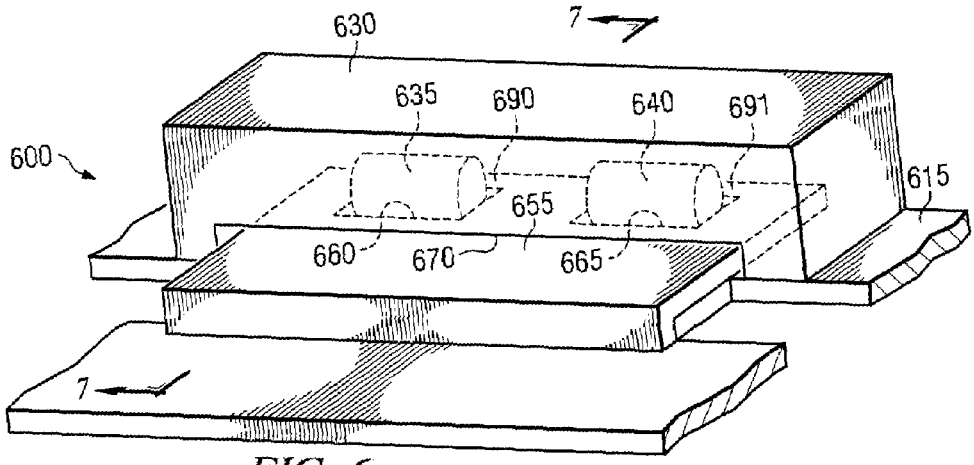
FIG. 6 is a perspective view of an apparatus for coupling an embroidery accessory to an embroidery machine in accordance with an illustrative embodiment.

Turning now to FIG. 6, a perspective view of an apparatus for coupling an embroidery accessory to an embroidery machine is depicted in accordance with an illustrative embodiment. Specifically, FIG. 6 shows embroidery accessory coupling system 600, which is a non-limiting example of a portion of embroidery accessory coupling system 200 in FIG. 2.

In embroidery accessory coupling system 600, attachment adapter 655 is inserted into acceptor 630. Attachment adapter 655 passes through acceptor notch 670, which is a space defined by a bottom edge of acceptor 630 and a top edge of support bar 615. Acceptor notch 670 is large enough to allow the passage of attachment adapter 655.

Attachment adapter 655 includes adapter notches 660 and 665. Magnets 635 and 640 fall into a space defined by adapter notches 660 and 665, respectively. Magnets 635 and 640 may be magnetically attracted to support bar 615, thereby forcing magnets 635 and 640 downward into adapter notches 660 and 665.

The presence of and magnetic attraction caused by magnets 635 and 640 provides a threshold resistance that must be overcome before attachment adapter 655 may be removed from acceptor notch 670. Specifically, a threshold pulling force must be exerted upon attachment adapter 655 in order for resistance portions 690 and 691 of attachment adapter 655 to traverse the area occupied by magnets 635 and 640. Thus, embroidery accessory coupling system holds attachment adapter 655, and the embroidery accessory to which attachment adapter 655 is coupled, firmly into position while an embroidery machine embroiders a pattern onto a piece of fabric mounted onto the embroidery accessory.

In another embodiment, attachment adapter 655 does not include adapter notches 660 and 665. In this embodiment, attachment adapter 655 is held firmly into place due to the magnetic attraction between magnets 635 and 640 and attachment adapter 655.

In another embodiment, embroidery accessory coupling system 600 does not include adapter notches 660 and 665 or magnets 635 and 640. In this embodiment, acceptor 630 is magnetic. Hence, attachment adapter 655 is held firmly into place by the magnetic attraction between acceptor 630 and attachment adapter 655.

Figure 7:
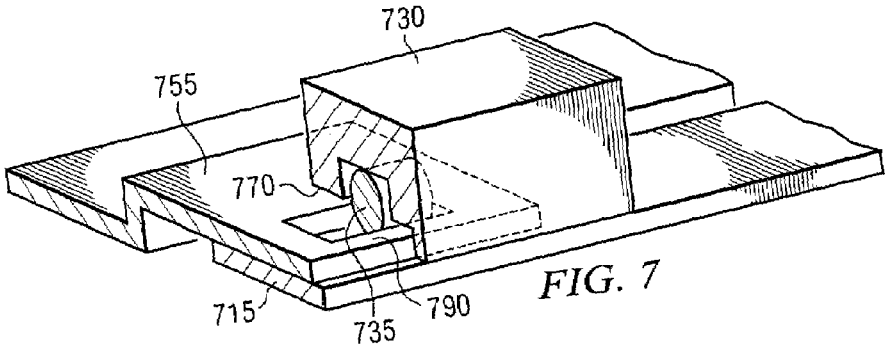
FIG. 7 is a perspective view of an apparatus for coupling an embroidery accessory to an embroidery machine in accordance with an illustrative embodiment.

Turning now to FIG. 7, a perspective view of an apparatus for coupling an embroidery accessory to an embroidery machine is depicted in accordance with an illustrative embodiment. Specifically, FIG. 7 shows a cross-sectional view of embroidery accessory coupling system 600 as defined by the cross-section line 7 in FIG. 6.

Attachment adapter 755 is inserted into acceptor 730 via acceptor notch 770. The magnetic attraction between magnet 735 and support bar 715 resists the movement of resistance portion 790 of attachment adapter 755 toward acceptor notch 770. Alternatively, resistance may be provided by the magnetic attraction between acceptor 730, magnet 735, attachment adapter 755, support bar 715, or any combination thereof. When a sufficient pulling force is exerted on attachment adapter 755, the magnetic attraction between magnet 735 and support bar 715 is overcome such that magnet 735 is lifted away from support bar 715, thereby allowing resistance portion 790 to pass out of acceptor 730.

Figure 8:
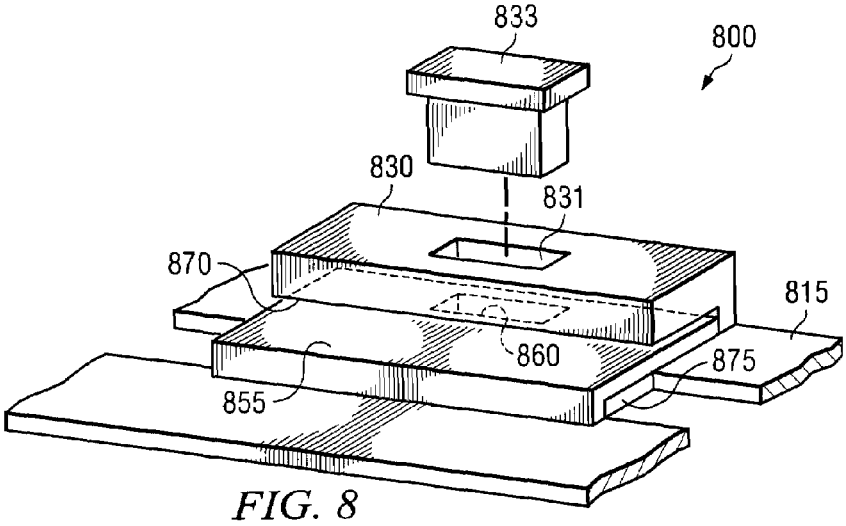
FIG. 8 is a perspective view of an apparatus for coupling an embroidery accessory to an embroidery machine in accordance with an illustrative embodiment.

Turning now to FIG. 8, a perspective view of an apparatus for coupling an embroidery accessory to an embroidery machine is depicted in accordance with an illustrative embodiment. Specifically, FIG. 8 shows embroidery accessory coupling system 800, which has a latch mechanism for securing attachment adapter 855 to acceptor 830.

In embroidery accessory coupling system 800, acceptor 830 is contiguous with support bar 815. Attachment adapter 855 is inserted into acceptor 830 at acceptor notch 870.

Acceptor 830 also includes link notch 831. Upon inserting attachment adapter 855 into acceptor 830, link notch 831 may be aligned with adapter notch 860. Upon aligning link notch 831 with adapter notch 860, link 833 may be inserted into link notch 831 and adapter notch 860. Hence, attachment adapter 855 is firmly held in acceptor 830 to provide the requisite support for a pattern to be embroidered on an embroidery accessory. Lip 875 provides further support to attachment adapter 855 and prevents attachment adapter 855 from moving in a downward vertical direction. Attachment adapter 855 may also be decoupled from acceptor 830 by removing link 833 from link notch 831 and adapter notch 860.

FIG. 8 shows link 833, link notch 831, and adapter notch 860 as having rectangular cross sections. However, link 833, link notch 831, and adapter notch 860 may have a cross section of any shape. For example, link 833, link notch 831, and adapter notch 860 may have a circular, elliptical, triangular, or polygonal cross sectional shape. Link 833 may also be magnetic to increase the support provided to attachment adapter 855.

Figure 9:
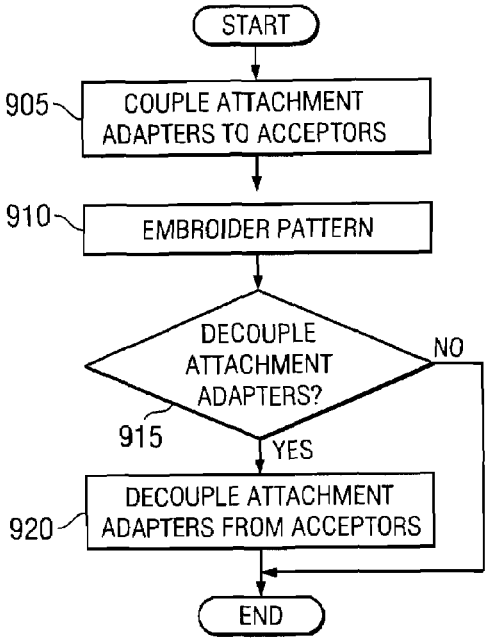
FIG. 9 is a flowchart illustrating a process for coupling an embroidery accessory to an embroidery machine in accordance with an illustrative embodiment.

Turning now to FIG. 9, a flowchart illustrating a process for coupling an embroidery accessory to an embroidery machine is depicted in accordance with an illustrative embodiment. The process illustrated in FIG. 9 may be implement by a human or machine, including a computerized machine.

The process begins by coupling a set of attachment adapters to a set of acceptors (step 905). The set of attachment adapters are coupled to an embroidery accessory. The set of acceptors are attached to a support bar. Also, the support bar is coupled to the embroidery machine.

The process embroiders a pattern onto a piece of fabric that is mounted on the embroidery accessory (step 910). The process then determines whether to decouple the set of attachment adapters from the set of acceptors (step 915). If the process determines not to decouple the set of attachment adapters from the set of acceptors, the process terminates. If the process determines to decouple the set of attachment adapters from the set of acceptors, then the process decouples the set of attachment adapters from the set of acceptors (step 920). The process then terminates.

The description of the preferred embodiment of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention the practical application to enable others of ordinary skill in the art to understand the invention for various embodiments with various modifications as are suited to the particular use contemplated.

What is claim is:

1. An apparatus for coupling an embroidery accessory to an embroidery machine, the apparatus comprising:

a support bar comprising a set of support members and a set of support bar mounts, wherein the set of support bar mounts affixes the support bar to a pantograph coupled to the embroidery machine;

a set of acceptors attached to the support bar;

the embroidery accessory comprising a set of attachment adapters, and wherein the set of attachment adapters are adapted to be placed on top of the set of support members coupling the set of attachment adapters to the set of acceptors, and wherein each of the set of attachment adapters includes a set of adapter notches; and a set of magnets, wherein the set of magnets is disposed between the support bar and the set of acceptors.

2. The apparatus of claim 1, wherein the support bar is coupled to the embroidery machine by the pantograph.

3. The apparatus of claim 1, further comprising:

a set of magnet notches, wherein the set of magnet notches are disposed on the set of acceptors, and wherein each of the set of magnet notches is adapted to hold at least one of the set of magnets.

4. The apparatus of claim 1, wherein each of the set of magnets is adapted to be inserted into a respective one of the set of adapter notches.

5. The apparatus of claim 1, wherein the embroidery accessory is a cap device for supporting an item for embroidery.

6. The apparatus of claim 1, wherein the embroidery accessory is a frame.

7. The apparatus of claim 1, wherein the embroidery accessory is a set of arms for supporting an embroidery hoop.

8. The apparatus of claim 1, wherein the support bar and the set of acceptors are composed of metal.

9. The apparatus of claim 1, wherein each adapter notch in the set of adapter notches comprises a rectangular, square, elliptical, circular, or triangular shape.

10. The apparatus of claim 1, wherein each magnet in the set of magnets comprises a cylindrical, cube, rectangular prism, ring, elliptical cylinder, or triangular prism shape.

11. The apparatus of claim 1, wherein each adapter notch in the set of adapter notches comprise a shape accommodating a shape of each magnet in the set of magnets.

12. The apparatus of claim 1, wherein the set of attachment adapters are held in place by magnetic attraction of the set of magnets to the set of acceptors and the set of attachment adapters.

13. The apparatus of claim 1, wherein the set of attachment adapters are decoupled from the set of acceptors by pulling the embroidery accessory with a force sufficient to overcome magnetic attraction of the set of magnets to the set of attachment adapters.

14. A method for coupling an embroidery accessory to an embroidery machine, the method comprising:

inserting a set of magnets that are disposed between the support bar and the set of acceptors into a set of adapter notches, wherein at least one of the set of adapter notches are included in each of the set of attachment adapters; and coupling a set of attachment adapters to a set of acceptors, wherein the set of attachment adapters are coupled to the embroidery accessory, wherein the set of acceptors are attached to a support bar, and wherein the support bar is coupled to the embroidery machine.

15. The method of claim 14, further comprising:

embroidering a pattern on a piece of fabric that is mounted on the embroidery accessory.

16. The method of claim 14, wherein the set of magnets are disposed in a set of magnet notches, and wherein the set of acceptors comprise the set of magnet notches.

17. The method of claim 14, wherein the embroidery accessory is one of a cap device, a frame, and a set of arms.

18. The method of claim 14, further comprising:

decoupling the set of attachment adapters from the set of acceptors.

19. An apparatus for coupling an embroidery accessory to an embroidery machine, the apparatus comprising:

a support bar comprising at least one support member and a set of support bar mounts, wherein the set of support bar mounts affixes the support bar to a pantograph coupled to the embroidery machine by a pantograph;

a set of acceptors attached to the support bar, and wherein the set of acceptors comprise a set of latch mechanisms;

the embroidery accessory, wherein the embroidery accessory comprises a set of attachment adapters, wherein each of the set of attachment adapters includes at least one of a set of adapter notches; and a set of links, wherein the set of links are adapted to be inserted through the set of latch mechanisms and the set of attachment adapters such that the set of attachment adapters are coupled to the set of acceptors.

* * * * *